US005947834A

United States Patent [19]

Hope et al.

[11] Patent Number: 5,947,834

[45] Date of Patent: Sep. 7, 1999

[54] ADJUSTABLE GOLF SWING TRAINING APPARATUS

[76] Inventors: Lee A. Hope, 15640 Clarendon Hills Dr., Granger, Ind. 46530; Charles E. Rhodes, 1040 Joliet Dr., Niles, Mich. 49120

[21] Appl. No.: 09/139,238

[22] Filed: Aug. 25, 1998

Related U.S. Application Data

[62] Division of application No. 09/016,198, Jan. 30, 1998.

[51] Int. Cl.[6] ..... A63B 69/36

[52] U.S. Cl. ..... 473/224; 473/218; 473/229; 473/258; 473/279; 473/273

[58] Field of Search ..... 473/223, 224, 473/218, 229, 258, 279, 273

[56] References Cited

U.S. PATENT DOCUMENTS

| | | | |
|---|---|---|---|
| Re. 32,397 | 4/1987 | Self et al. | 473/229 |
| 2,328,408 | 8/1943 | Beil et al. . | |
| 3,429,571 | 2/1969 | Abel, Jr. . | |
| 3,604,712 | 9/1971 | Prior et al. . | |
| 3,848,873 | 11/1974 | Linning . | |
| 4,261,573 | 4/1981 | Richards . | |
| 4,486,020 | 12/1984 | Kane et al. . | |
| 4,580,786 | 4/1986 | Shipley . | |
| 4,653,757 | 3/1987 | Wilkinson . | |
| 4,815,743 | 3/1989 | Meeker et al. . | |
| 5,005,836 | 4/1991 | Nelson . | |
| 5,026,065 | 6/1991 | Bellagamba . | |
| 5,050,874 | 9/1991 | Fitch . | |
| 5,069,456 | 12/1991 | Bellagamba . | |
| 5,125,882 | 6/1992 | La Mothe et al. . | |
| 5,139,264 | 8/1992 | Wootten . | |
| 5,150,901 | 9/1992 | Stawicki . | |
| 5,156,402 | 10/1992 | Hart . | |
| 5,188,367 | 2/1993 | Gipe et al. . | |
| 5,221,089 | 6/1993 | Barrett . | |
| 5,242,344 | 9/1993 | Hundley . | |
| 5,265,876 | 11/1993 | Moon . | |
| 5,288,073 | 2/1994 | Noel . | |
| 5,421,578 | 6/1995 | Uebele, Jr. . | |
| 5,478,079 | 12/1995 | Liberatore et al. . | |
| 5,538,251 | 7/1996 | Harper . | |

*Primary Examiner*—George J. Marlo
*Attorney, Agent, or Firm*—Young & Basile, P.C.

[57] ABSTRACT

An adjustable golf swing training apparatus is disclosed, the apparatus comprising a support structure for supporting the golf swing training apparatus in a support plane, and a telescopic swing training arm connected to the support structure and further connectable to a golf club shaft. The telescopic swing training arm is magnetically biased toward a predetermined length, whereby the swing training arm is urged toward the predetermined length in response to axial movement thereof in either first or second directions away from the predetermined length. The predetermined length is such as to accommodate a preferred path of travel for a golf club through a portion of a golf swing.

24 Claims, 8 Drawing Sheets

10
14
16
18
20
22
24
26
28
32
34
42
44
58
64
68
70
72
82
84
86
93
97
130

106
110
108
107
112
116
114
111
113
24
120
104
118
115
100
109
102
101
96
94
86

ADJUSTABLE GOLF SWING TRAINING APPARATUS

This application is a divisional of U.S. patent application Ser. No. 09/016,198, filed Jan. 30, 1998.

FIELD OF THE INVENTION

The present invention relates to a golf swing training apparatus and more particularly, to an adjustable golf swing training apparatus that indicates whether a golfer's swing is in error and repeatedly aligns the golfer in a consistent and proper location.

BACKGROUND OF THE INVENTION

In developing a proper golf swing, most professional golfers would admit that the proper golf swing technique is to bring the club back in a consistent, customized swing plane and swing down and through the ball in another swing plane by pivoting the body, moving the arms and hips forward, following through the swing, and shifting the weight towards the target. Other golf pros contend that the golf club head actually follows one swing plane in both the back swing and the follow through but that the angle between the golfer's hands and the golf club shaft change during the follow through thus creating a different swing plane at the golfer's hands. Either way, to develop a consistent and effective golf swing, a golfer must develop a repeatable swing that follows the swing planes described above. Errors occur in striking the ball when the golfer deviates from the swing plane created in the back swing, and thus, the club is not returned properly to the originating position behind the ball. If an improper or inconsistent swing is used, practiced and repeated, the golfer will make inconsistent and unpredictable contact with the ball resulting in erratic performance.

Many golf swing training apparatuses have been developed in an attempt to teach the proper swing plane and allow for an effective golf swing. Some of these training devices utilize a "swing arm" or "radius arm" that attaches to the golf club shaft, golf club head or hands of the golfer in order to encourage or force the golfer to swing along a predetermined arc dependent upon the length, position and method of attachment of the swing arm. Golf swing training apparatuses have been developed using flexible swing arms, such as a cable, or rigid swing arms which utilize a rod or tubing to guide the golf club in the ascending and descending portions of the swing. Other golf swing training apparatuses have been developed utilizing a pendulum motion along a proper swing plane or arc in order to encourage a swing that is consistent and repetitive.

Almost all of the golf swing training apparatuses which utilize rigid swing arms force the golfer to swing the club in a predetermined plane. Such devices do not require any conscious input by the golfer, and thus, the apparatus becomes a teaching crutch which lessens the effectiveness of the training device. The disadvantage of such devices is that the path of the club is completely controlled by the apparatus, and therefore, the golfer's swing becomes dependent on the training apparatus, thus diminishing the golfer's ability to play the game without the benefit of the training apparatus. These apparatuses do not provide any feedback to the golfer that he may be trying to force his swing in or out of the predetermined swing plane. In addition, those training apparatuses which utilize flexible swing arms, such as cable, do not ensure that the proper swing plane is being maintained since there is no indicator that the cable is taut throughout the entire swing.

Most all of the golf swing training apparatuses that utilize swing arms require that the back swing and the follow through swing be in one predetermined swing plane. Most professional golfers agree that the back swing of a golf swing occurs in one swing plane and the follow through of a golf swing occurs in a second swing plane. This change in swing planes requires an adjustment in the length of the swing arm as the golfer's swing makes the transition to from the back swing to the follow through swing. Most golf swing training apparatuses which utilize rigid swing arms do not provide any compensation for the length of the swing arm as the golfer moves from the back swing to the follow through swing. Thus, these devices do not allow the golfer to perform or practice the optimal swing which will ensure the most effective play.

None of the golf swing training apparatuses provide an alignment mechanism or set-up procedure to ensure that the golfer is properly and repeatedly aligned with respect to the golfer's stance and the golf ball. In order to assure a consistent and repetitive swing, it is necessary to ensure that the golfer maintains a consistent and repetitive stance so that the feel of the swing remains consistent to the golfer. Most all of the training devices simply require the golfer to approach and utilize the device without considering where or how the golfer is or was aligned from swing to swing or from training session to training session. Some of the golf training apparatuses do provide for a vertical height adjustment of the swing arm to adjust for varying heights of the golfers, and other devices have utilized markings for indicating the spacing between the golfer's feet. Still, none of these devices ensure a consistent and repetitive positioning of the golfer relative to the golf swing training apparatus.

It would be desirable to provide a golf swing training apparatus that provided a golfer with a proper swing while providing a response to the golfer that the proper swing plane was or was not maintained. It would also be desirable to provide a golf swing training apparatus that allowed a golfer to utilize one swing plane in his back swing and utilize a second swing plane in his follow through swing. It would further be desirable to provide a golf swing training apparatus that provided an apparatus for consistently and repeatedly aligning a golfer with the golf swing training apparatus.

SUMMARY OF THE INVENTION

The present invention provides an adjustable golf swing training apparatus that provides a support structure having a vertical support member, a horizontal support member, and a support plane. The apparatus also provides a telescopic swing training arm having one end articulately coupled to the vertical support member for rotational movement thereabout and an opposite end articulately connectable to a golf club shaft. The swing training arm is biased toward a predetermined length wherein the swing training arm may contract and expand from a predetermined length in response to a golfer's swing. The present invention also provides a stance support for properly and repeatedly aligning a golfer in a two dimensional stance plane substantially perpendicular to the support plane.

In the preferred form, the swing training arm is connected to the vertical support member by a universal joint. The swing training arm is telescopic and has an inner rod and an outer tube wherein the inner rod slides axially within the outer tube. The outer tube of the telescopic swing training arm has at least one magnetic portion connected thereto, and the inner rod has a magnetically attracted member that is axially alignable with the magnetic portion of the outer tube. The magnetic portion of the outer tube and the magnetically attracted member of the inner rod are radially spaced so that the magnetically attracted member is magnetically attracted to the magnetic portion. The magnetic attraction biases the inner rod to a predetermined position with respect to the outer tube thus creating a predetermined biased length of the telescopic swing arm. In another embodiment, a piezo-electric switch, which is responsive to the magnetic portion being axially misaligned relative to the magnetically attracted member, may be utilized to actuate an audio signal responsive to the piezo-electric switch to indicate to the golfer that the telescopic swing arm has varied from its predetermined length.

In the preferred form, the present invention provides that the swing training arm is connectable to a golf club shaft by a swivel clamp assembly. The swivel clamp assembly provides a first clamp connectable to the golf club shaft wherein the golf club shaft is allowed to rotate about and move axially along its longitudinal axis relative to the first clamp. The first clamp is positioned just below the grip of the golf club, wherein the grip prevents the grip end of the golf club from passing through the first clamp. A second clamp is connectable to the golf club shaft in a fixed position relative to the golf club shaft just below the first clamp. The second clamp prevents the golf club shaft from moving along the longitudinal axis of the golf club shaft toward the golf club head. A third clamp is fixedly connected to the end of the swing training arm, and a reinforced flexible material is utilized to connect the first clamp to the third clamp in order to provide limited multi-directional movement of the golf club shaft relative to the swing training arm.

The present invention also provides a stance support that is adjustably connected to the horizontal support member of the support structure. The stance support provides a front portion which is adjustably connected to the horizontal support structure by a pair of releaseable fasteners. A first indicia is located on the front portion of the stance support to indicate the position of the stance support with respect to the vertical support member of the support structure. The stance support also provides a pair of substantially parallel side rails which are substantially perpendicular to the front portion of the support structure. The side rails of the support structure slidably receive a stance mat, whereon a golfer stands, and a tee mat, whereon the golf ball is placed. A second indicia is located on at least one of the side rails for indicating the distance of the stance mat from the support plane. A third indicia is located on the stance mat for indicating the spacing between the golfer's feet. The third indicia corresponds to the first indicia to properly align the golfer with respect to the vertical support member of the support structure. A fourth indicia is also placed on the side rails to indicate the distance of the tee mat from the support plane, and a fifth indicia is provided on the vertical support member of the support structure to indicate the vertical height of the swing training arm.

The present invention also provides a knee pad for restricting improper movement of the golfer's knee during the golf swing. A planar support structure is connected to the side rails of the support structure and is located behind the golfer. The planar support structure rises vertically from the side rails and substantially parallel to the vertical support member. A rectangular padded section is adjustably connected to the planar support member and extends outward from the planar support toward the support plane. The pad is adjacently positioned on the outside of the right knee of a right handed golfer (left knee of a left-handed golfer) to limit outwardly swaying of the right knee.

In another form of the invention, the support structure may be self-supporting, as commonly seen in self-standing basketball nets. This embodiment of the support structure includes a weighted base which is commonly filled with sand, water, or weight, and the vertical support member and the horizontal support member are connected to the weighted base to provide a similar support structure as defined in the preferred embodiment.

To this end, the objects of the present invention are to provide a new and improved adjustable golf swing training apparatus that provides a training aid for indicating a proper golf swing while indicating any errors that may occur during the golfer's swing; to provide a new and improved adjustable golf swing training apparatus that allows a golfer to swing in one swing plane during the back swing and a second swing plane during the follow through swing; and to provide a new and improved golf swing training apparatus that provides a mechanism to repeatedly align a golfer to utilize the golf swing training apparatus.

Other objects, advantages, and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views and wherein.

DESCRIPTION OF THE PREFERRED EMBODIMENT

Figure 1:
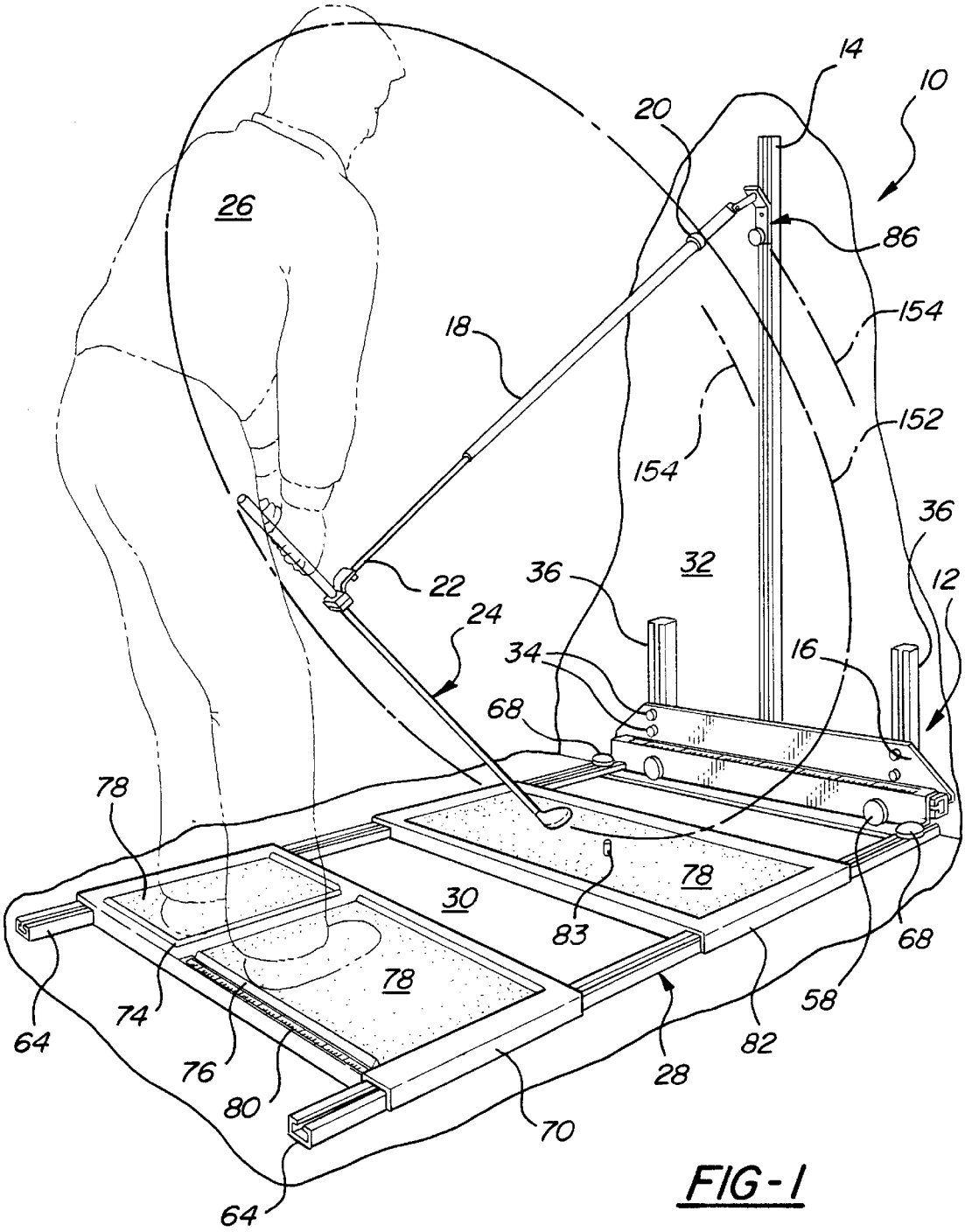
FIG. 1 is a perspective view showing the adjustable golf swing training apparatus being utilized by a right-handed golfer.

Referring to the drawings, the present invention will now be described in detail with reference to the preferred embodiment.

Figure 2:
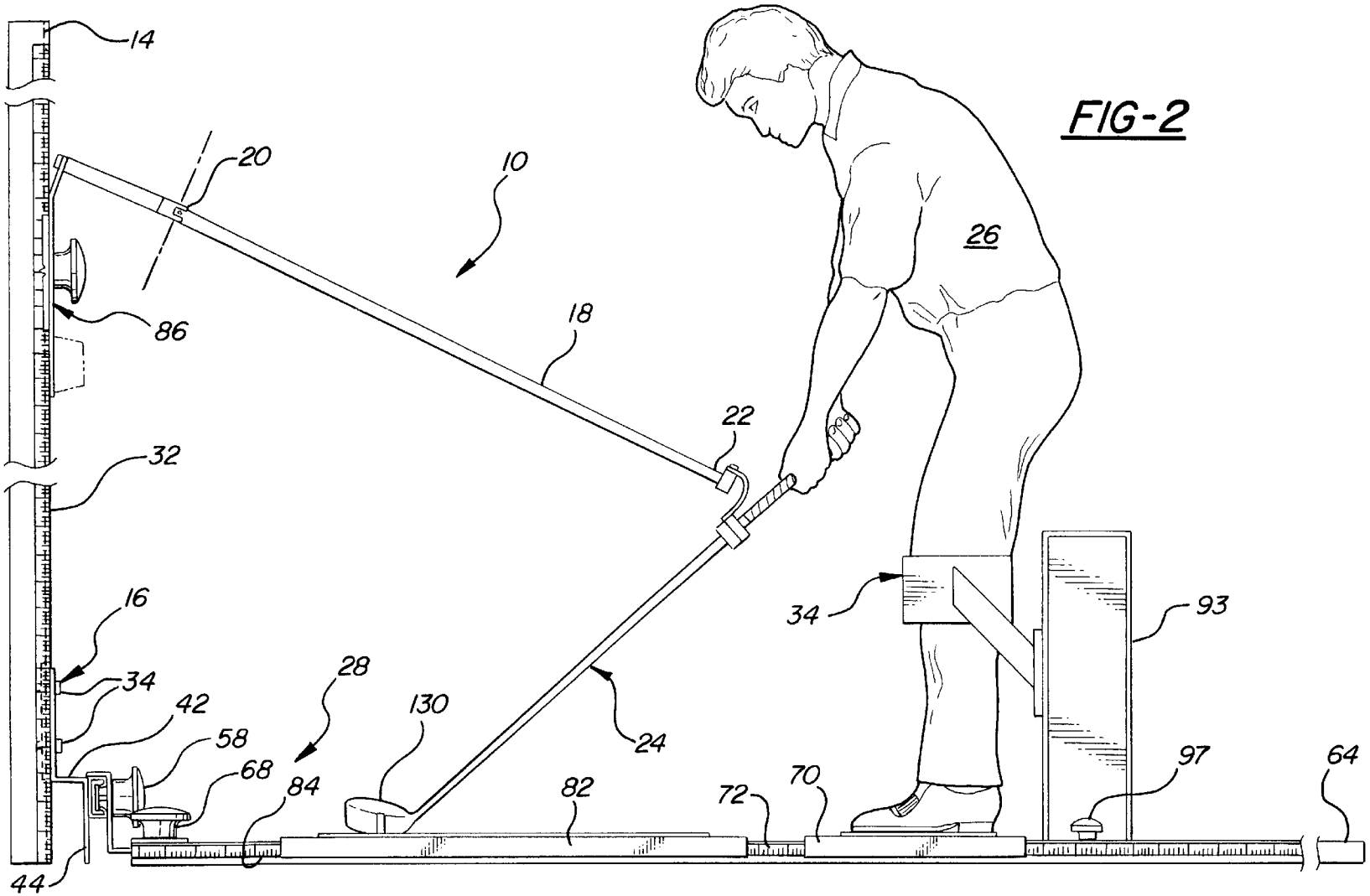
FIG. 2 is a side view of the adjustable golf swing training apparatus being utilized by a left-handed golfer.

FIGS. 1 and 2 shows the adjustable golf swing training apparatus 10 in its preferred form. The golf swing training apparatus 10 provides a support structure 12 having a vertical support member 14 and a horizontal support member 16. The support structure 12 may be connected to any reinforced foundation (not shown) such as the studs or steel beams of a building, concrete walls, self-standing poles that are reinforced by struts or a foundation, or any other foundation which may provide for a rigid support structure. A telescopic golf swing training arm 18 has one end 20 adjustably and articulately connected to the vertical support member 14 and an opposite end 22 connectable to a golf club 24. A golfer 26 is properly positioned on a stance support 28 through the aid of golf pro (not shown); video tape, or written instruction. The stance support 28 properly aligns the golfer 26 in a two-dimensional stance plane which is substantially perpendicular to a support plane 32 provided by the support structure 12. Indicators are provided on the stance support 28 to allow the golfer 26 to repeatedly align himself on the swing training apparatus 10 between swings and between practice sessions. As seen in FIG. 2, a knee pad 34 is provided adjacent and outside the left-handed golfer's left leg to prohibit improper movement of the knee during the golfer's swing.

Figure 4:
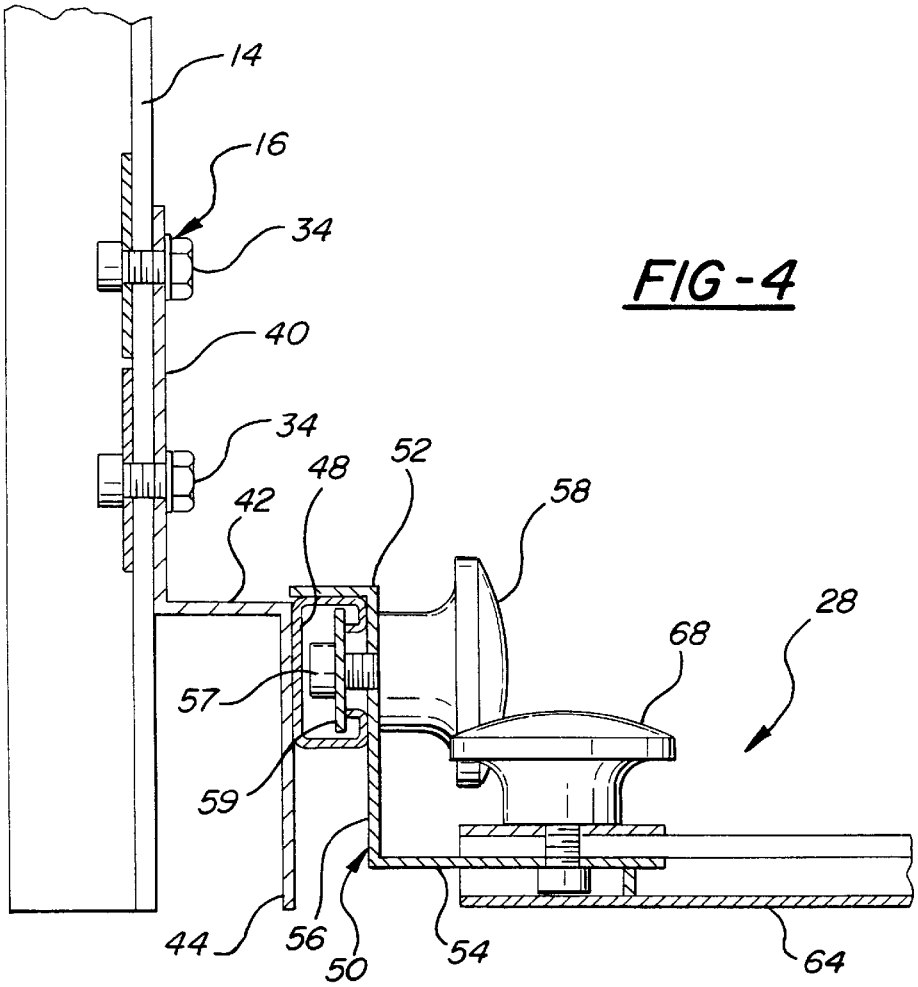
FIG. 4 is a sectional view of the horizontal support member and the stance support.
Figure 5:
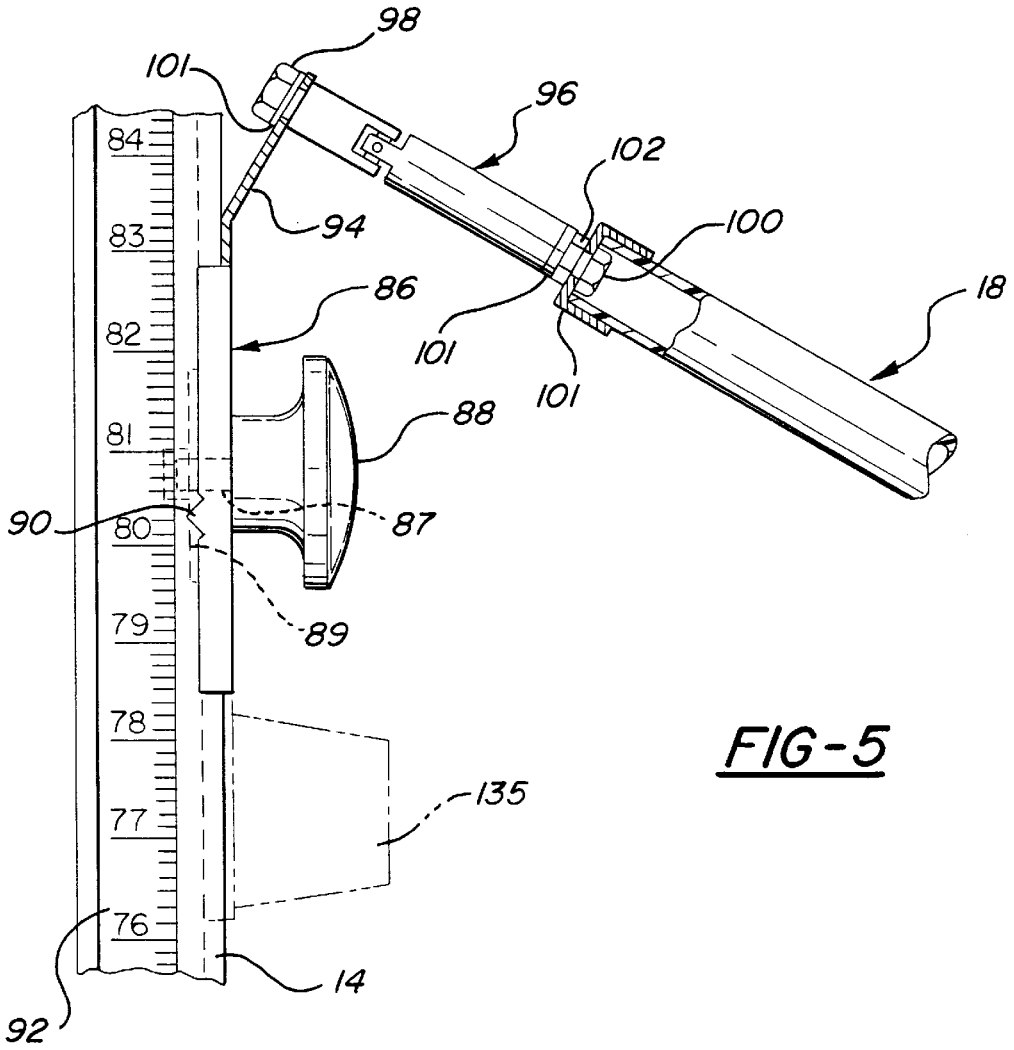
FIG. 5 is a side view of the vertical adjustment bracket.
Figure 11:
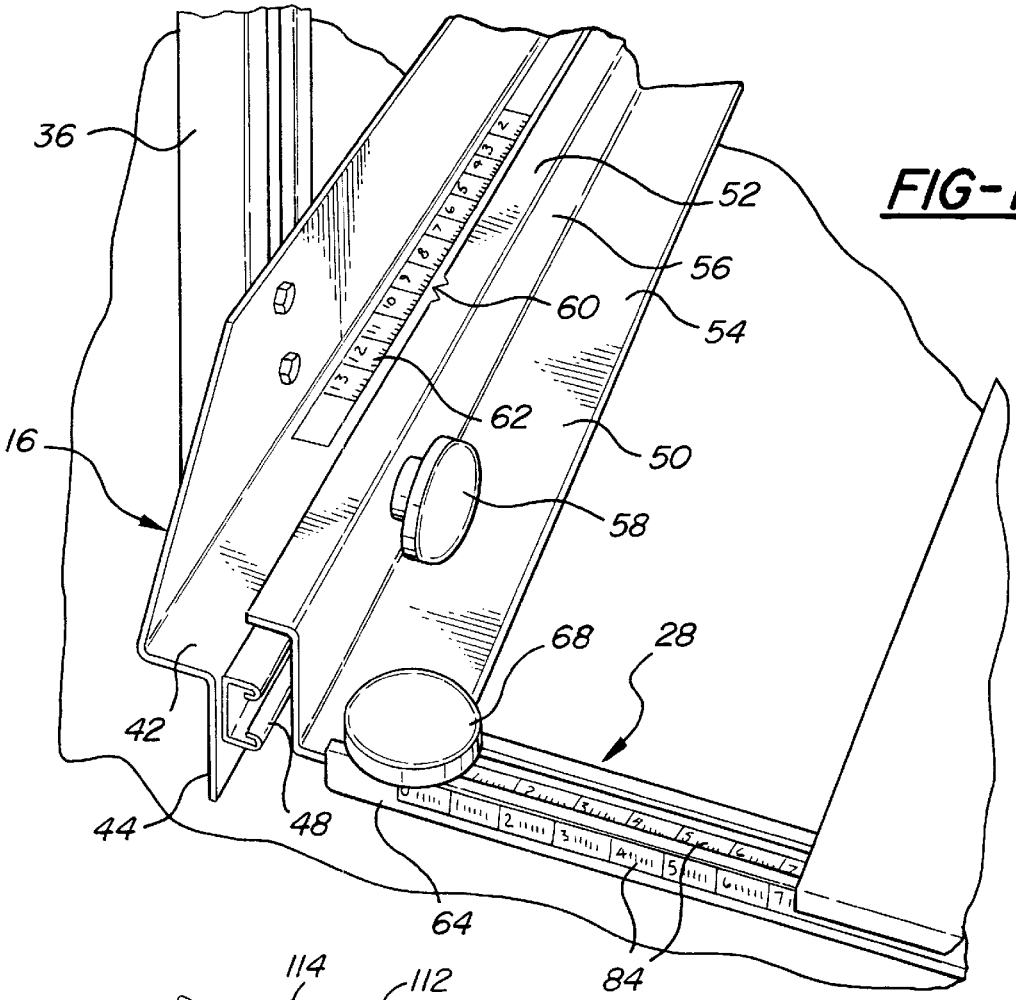
FIG. 11 is a perspective view of the horizontal support structure and the stance support.

In order to support the swing training apparatus 10, the vertical support member 14 is preferably fabricated from an aluminum "unistrut" railing having an open ended C-shaped cross-section wherein the ends of the cross-section curve inward toward the opening (horizontal unistrut member 48 has a similar cross-section as shown in FIGS. 4 and 11). The vertical support member 14 is connected to a foundation by lag screws (not shown). A pair of smaller vertical support members 36 are also connected to the foundation by lag screws (not shown) and are substantially parallel to the vertical support member 14. The smaller vertical support members 36 are also fabricated from aluminum having the same "unistrut" cross-section as vertical support member 14. The horizontal support member 16 is connected to both the vertical support member 14 and the smaller vertical support members 36 by bolts 34. As seen in FIGS. 1, 2, 4, and 11, the horizontal support member 16 is fabricated from sheet metal or aluminum and has a top portion 40 that extends across and is substantially parallel to the three vertical support members 14, 36. The horizontal support member 16 also has a mid-portion 42 which extends outwardly away from and substantially perpendicular to the vertical supports 14, 36 and the top portion 40 of the horizontal support member 16. A bottom portion 44 of the horizontal support member 16 extends downward substantially perpendicular to the mid-portion 42 of the horizontal support member and substantially parallel to the top portion 40 of the horizontal support member 16. The bottom portion 44 of the horizontal support member 16 either contacts or is slightly above the floor or ground. The top portion 40 of the horizontal support member 16 may have a plurality of apertures (not shown) extending therethrough to accommodate for studs that are spaced at eight inch, twelve inch, sixteen inch, and twenty-four inch intervals.

In order to adjustably connect the stance support 28 to the horizontal support member 16, a horizontal "unistrut" member 48, having a cross-section similar to the vertical support members 14, 36, is connected to the bottom portion 44 of the horizontal support member 16 by bolts (not shown). The stance support 28 has a front portion 50 that is fabricated from sheet metal. The front portion 50 has a top 52 and a bottom 54 that are substantially parallel to one another and a mid-portion 56 that connects the top 52 and the bottom 54 and is substantially perpendicular to both the top 52 and the bottom 54. The front 50 of the stance support 28 abuts and overlies the horizontal "unistrut" member 48 so that the mid-portion 56 overlies and covers the open side of the horizontal "unistrut" member 48. A pair of knobs 58 having threaded apertures therein receive threaded fasteners 57 that extend through apertures provided in the mid-portion 56 of the front 50 of the stance support 28. Small steel plates 59 having apertures extending therethrough are positioned behind the curved ends of the horizontal "unistrut member" 48. The threaded fasteners 57 extend through the apertures provided in the steel plates and thread into the threaded apertures provided in knobs 58. By threading the knobs 58 onto the threaded fasteners 57, the front 50 of the stance support 28 can be releaseably fastened to and adjusted along the horizontal support member 16. A pair of pointers 60 (only one shown) are notched into the top 52 of the front 50 of the stance support 28 to indicate the position of the stance support 28 along the horizontal support 16 with respect to the vertical support member 14. The pointers 60 point to a first indicia 62 which is located on the mid-portion 42 of the horizontal support member 16. The first indicia 62 is scaled sequentially in inches wherein right handed golfers utilize the numbers to the left of the vertical support member 14 and left handed golfers use the numbers to the right of the vertical support member 14. Labels may be provided to indicate which numbers are to be utilized for right and left handed golfers.

To align the golfer 26 in the two-dimensional support plane 32, the stance support 28 provides a pair of side rails 64 connected to the bottom portion 54 of the front 50 of the stance support 28. The side rails 64 are fabricated from aluminum and have a similar "uninstrut" cross-section as the vertical support members 14, 36. Slots (not shown) are provided near the ends of the bottom portion 54 of the front 50 of the stance support 28 to receive the ends of the side rails 64. Apertures are provided in the bottom portion 54 of the front 50 of the stance support 28 to receive a threaded fastener 68 for securing the side rails 64 to the bottom portion 54 of the front 50 of the stance support 28. The side rails 64 are substantially parallel to one another and substantially perpendicular to the support plane 32. The bottom surfaces of the side rails 64 rest or are supported by the floor or ground.

To position the golfer 26, the stance support 28 provides a stance mat 70 slidably connected to the side rails 64, as seen in FIGS. 1 and 2. The stance mat 70 is fabricated from a rectangular plastic molding that overlies the edges of the side rails 64. The underside of the stance mat 70 has a shape which complements the side rails 64 of the to stance support 28 so as to prohibit lateral movement of the stance mat 70 with respect to the side rails 64. The underside of the stance mat 70 also has a tongue portion (not shown) which extends into the open ended portion of the side rails 64 to enhance the sliding of the stance mat 70 along the length of the side rails 64. A second indicia 72 is located on the outside surface of at least one of the side rails 64 and/or inside the open ended portion of the side rails 64 to indicate the distance of the stance mat 70 from the support plane 32. The second indicia 72 is scaled sequentially in inches, but the second indicia 72 may comprise of any numerical or alphabetic orientation which allows a golfer 26 to repeatedly locate the orientation of the stance mat 70 relative to the support plane 32.

The top surface of the stance mat 70 has a separate portion for each foot of the golfer 26. In the case of a right handed golfer 26, a raised corner 74 is provided for locating the left heel of the golfer 26. A raised border 76 outlines a second area on the stance mat 70 for locating the right foot of the golfer 26. Both the first area and the second area are slightly recessed for receiving a section of artificial turf or indoor/outdoor carpeting 78 to provide for good traction and footing.

To indicate the distance between the golfers feet, a third indicia 80 is provided adjacent to the raised border 76 of the stance mat 70. The third indicia 80 provides a scaled sequential numbering of every two inches. The two inch sequential numbering of the third indicia 80 corresponds and correlates with the first indicia 62. Thus, when setting up the swing training apparatus 10, the number on the third indicia 80 is to be set at the same number as the first indicia 62. It should also be noted that a similar raised corner, raised border, and third indicia are provided on the opposite side of the stance mat 70 so that the stance mat 70 may be turned 180° relative to the side rails 64 and utilized for left handed golfers 26.

In order to indicate the position of the tee or golf ball, the stance support 28 provides a rectangular, plastic molded tee mat 82 which similarly complements and overlies the side rails 64 as described for the stance mat 70. The top surface of the tee mat 82 is slightly recessed to allow for the fitting of artificial turf or indoor/outdoor carpeting 78. Apertures may be provided in the artificial turf 78 to allow for rubberized tees 83 to extend through the artificial turf 78. The tee mat 82 slides along the side rails 64, and the distance of the tee mat 82 from the support plane 32 is determined by indicating the location of the tee mat 82 on a fourth indicia 84 which may be located on the side of the side rails 64 and/or inside the open end of the side rails 64. Preferably, the fourth indicia 84 and the third indicia 80 are combined into one indicia on the side rails 64.

Figure 9:
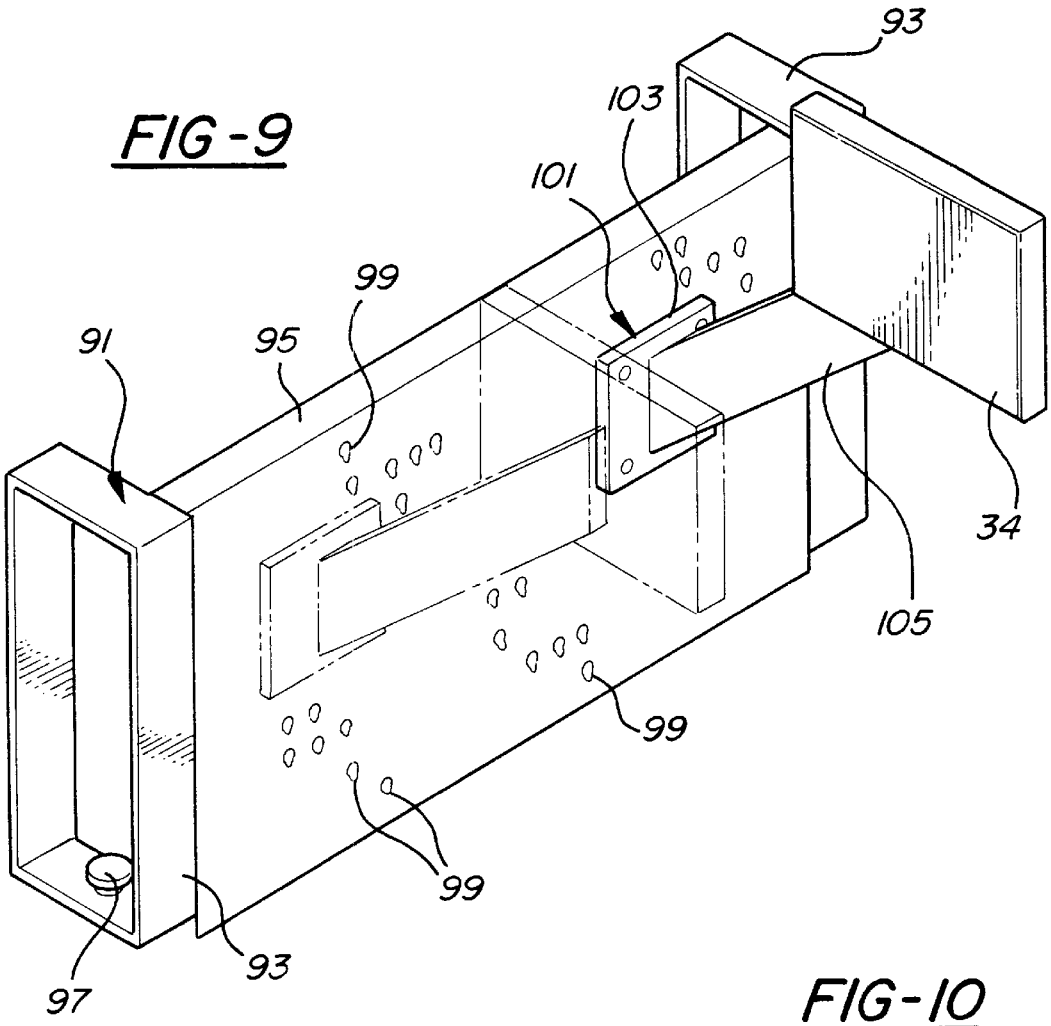
FIG. 9 is a perspective view showing the knee pad of the adjustable golf swing training apparatus.

To prohibit improper movement of the golfer's knee, the knee pad 34 is adjacently mounted on the outside of a left-handed golfer's left knee or the outside of right-handed golfer's right knee. As seen in FIG. 9, the knee pad 34 is supported by a planar support 91 having a pair of rectangular and substantially parallel posts 93 and a planar plate 95 extending between and connected to the posts 93. The bottoms of the posts 93 are adjustably connected to the side rails 64 by releasable fasteners 97.

The planar plate 95 has a plurality of tear shape apertures 99 for receiving bolt heads or screw heads (not shown) that extend from a mounting bracket 101 of the knee pad 34. The mounting bracket 101 provides a base plate 103 that is substantially parallel to the planar plate 95 and an extension 105 that extends at an upward angle from the base plate 103. The knee pad 34 is connected to the extension 105. By adjusting the posts 93 relative to the side rails 64 and the base plate 101 relative to the planar plate 95, the knee pad 34 may be positioned adjacent the golfer's knee regardless of the golfer's size or location.

In order to secure the swing training arm 18 to the vertical support member 14, a vertical adjustment bracket 86 is slidably adjustable along the vertical support member 14, as seen in FIGS. 1, 2, 5 and 7. The vertical adjustment bracket 86 has a U-shaped cross-section which overlaps and complements the open ended side of the vertical support member 14. The vertical adjustment bracket 86 provides a knob 88 having a threaded aperture therein. A steel plate 89 having an aperture extending therethrough extends behind the turned-in ends of the "unistrut" cross-section of the vertical support member 14, and a threaded fastener 87 extends through the aperture of the steel plate 89 and into the threaded aperture in the knob 88. By threading the fastener 87 into the knob 88 and tightening the steel plate 89 against the vertical support member 14, the vertical adjustment bracket 86 can be secured to the vertical support member 14. By loosening the steel plate 89 from the vertical support member 14, the vertical adjustment bracket 86 can be slidingly adjusted along the vertical support member 14. A pointer 90 is notched into a side of the vertical adjustment bracket 86, and the pointer 90 indicates the position of the vertical adjustment bracket 86 on a fifth indicia 92 located on the side of the vertical support member 14. The fifth indicia 92 is a sequential scale in inches starting from the ground or floor and extending to the top of the vertical support member 14. It should be noted that none of the indicia in the present invention are limited to a linear scale in inches, but rather, the indicia may comprise any numeral, alphabet or label which would allow for the recordation and repeated alignment of the golfer's positioning of the golf swing training apparatus 10.

To provide articulating motion of the swing training arm 18 relative to the vertical support member 14, the vertical adjustment bracket 86 has an end portion 94 which is bent outward at an acute angle relative to the vertical support member 14. A universal joint 96 has one end connected to the end portion 94 of the vertical adjustment bracket 86 by a bolt 98 and a lock washer 102. The opposite end of the universal joint 96 is connected to the swing training arm 18 by a bolt 100, lock washers 101, and a jam nut 102.

Figures 7, 8:
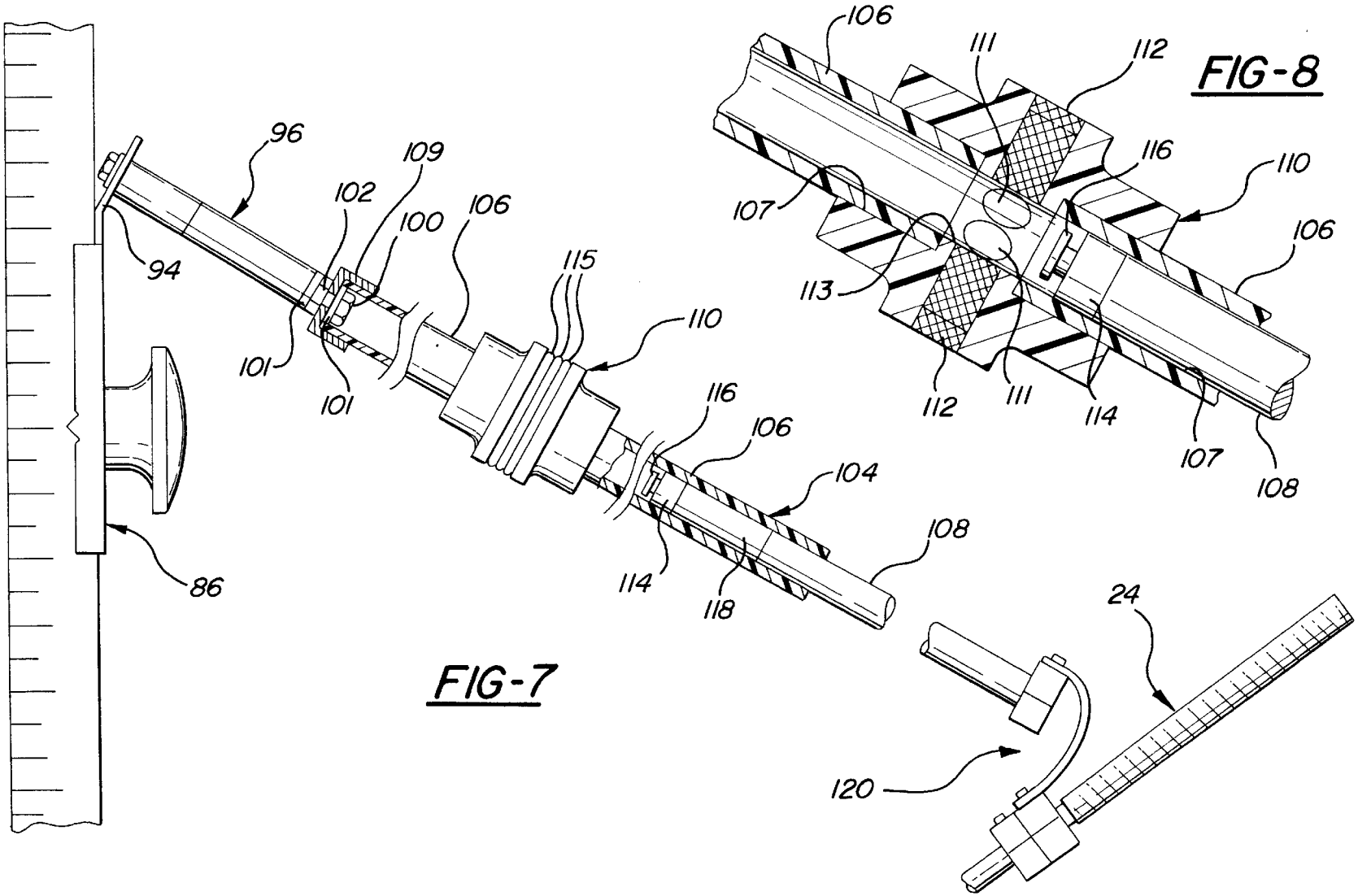
FIG. 7 is a plane view of the swing training arm.
FIG. 8 is a sectional view showing the magnetic coupling of the swing training arm.

In order to allow the swing training arm 18 to automatically adjust its length, the swing training arm 18 is telescopic and biased toward a predetermined length. As seen in FIGS. 7 and 8, the swing training arm 18 provides a telescopic shaft 104 having an outer tube 106 and an inner rod 108. The outer tube 106 may be fabricated from any suitable material, including poly-vinyl chloride, aluminum, graphite, steel, fiberglass, or any other rigid or semi-rigid material. Although not critical, the outer tube 106 is preferably fabricated from a non-magnetically attractable material. The one end of the outer tube 106 has a cap 109 and is connected to the universal joint 96 by bolt 100. The inner rod 108 slides axially into the opposite end of outer tube 106 along the longitudinal axis of the telescopic shaft 104, and the inner rod 108 is allowed to extend outward from the outer tube 106. The inner rod 108 may be fabricated from steel (sheltered from magnets by sleeve 118), graphite, fiberglass, aluminum or similar material that is non-magnetically attractable, sufficiently rigid, and has a suitably low coefficient of friction. If a magnetically attractable material is utilized, a non-magnetically attractable extension 118, as will be discussed supra, may be utilized to extend the inner rod 108 which is fabricated from a magnetically attractable material.

To bias the telescopic shaft 104 to a predetermined length, a magnetic housing 110 is disposed along the mid-portion of the outer tube 106 and is fabricated from a non-magnetic and non-magnetically attractable material. The magnetic housing 110 has a cylindrical configuration with a slightly larger mid-portion. The magnetic housing 110 has a stepped aperture extending axially therethrough wherein the magnetic housing 110 actually receives the ends of two separate segments of the outer tube 106 to form a continuous outer tube 106. The stepped aperture has two larger diameter segments 107 for receiving the ends of the outer tube segments 106 and a smaller diameter segment 113 connecting the two larger diameter segments 107. The smaller diameter segment 113 is slightly larger than the diameter of the inner rod 108 in order to slidingly receive the inner rod 108 and to provide a consistent bore through the outer tube 106. The magnetic housing 110 also has six cylindrical apertures 111 that are bored radially through the mid-portion of the magnetic housing 110. The radial apertures receive permanent magnets 112 that slip fit into the cylindrical apertures and are restrained by three o-rings 115.

The inner rod 108 has a steel slug 114 that is screwed onto the end of the inner rod 108 by screw 116. An aluminum or plastic sleeve 118 is press fit or glued onto the inner rod 108 adjacent the steel slug 114. The aluminum or plastic sleeve 118 is not necessary where a non-magnetic material is utilized for inner rod 108. The steel slug 114 is magnetically attracted to the magnets 112 in the magnetic housing 110, and the steel slug 114 rests in the center of the magnetic housing 110 to provide the predetermined biased length of the telescopic shaft 104. The aluminum or plastic sleeve 118 prohibits any magnetic attraction from the inner rod 108.

Figure 3:
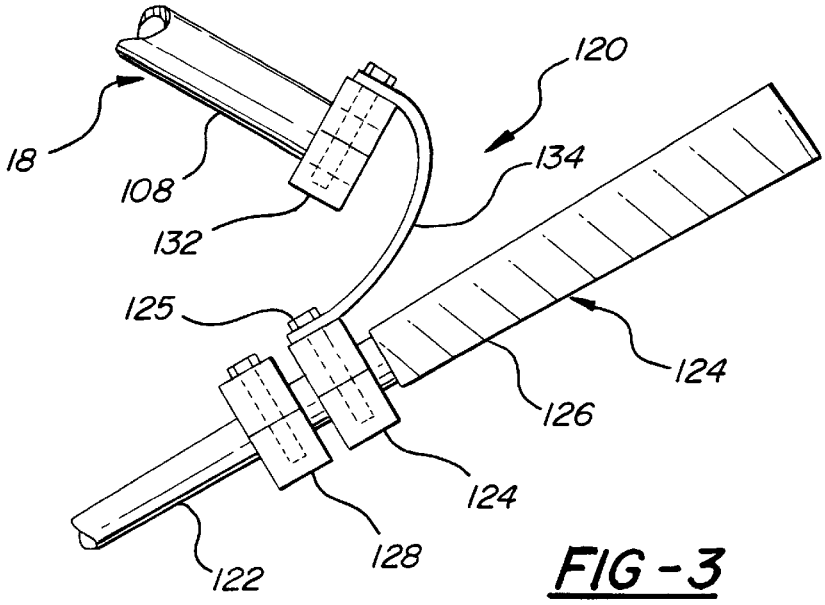
FIG. 3 is a plane view of the swivel clamp assembly.

To provide articulating movement between the swing training arm 18 and a golf club 24, a swivel clamp assembly 120 is provided to connect the inner rod 108 of the telescopic shaft 104 to a golf club shaft 122, as best seen in FIG. 3. The swivel clamp assembly 120 provides a first clamp 124 connected to the golf club shaft 122. The first clamp 124 has a clam shell design wherein two halves having hemispherical reliefs formed therein are connected together by two fasteners 125 to receive and hold the golf club shaft 122. The aperture formed by the two hemispherical reliefs in the first clamp 124 is slightly larger than the diameter of the golf club shaft 122 so that the shaft 122 may rotate and move axially along a longitudinal axis of the golf club shaft 122. The aperture formed in the first clamp 124 is also small enough so that the grip 126 of the golf club 24 cannot pass through the aperture in the first clamp 124. A second clamp 128, having the same configuration as the first clamp 124, is secured to the golf club shaft 122 on the opposite side of the first clamp 124 as the golf club grip 126. The second clamp 128 is tightly secured to the golf club shaft 122 so that the golf club shaft 122 does not move relative to the second clamp 128. The second clamp 128 abuts the first clamp 124 to prevent the golf club shaft 122 from sliding through the first clamp 124 toward the golf club head 130. A third clamp or connecting bar 132, is secured to the inner rod 108 so that the inner rod 108 cannot move relative to the connecting bar 132. The connecting bar 132 is a rectangular aluminum block having an aperture extending therethrough for receiving the inner rod 108. A pin is inserted through the rectangular block and the inner rod 108 to prevent relative movement between the inner rod 108 and the rectangular block of the connecting bar 132. A reinforced flexible material 134 fabricated from a reinforced rubber is connected to the first clamp 124 and the third clamp or connecting bar 132 to provide limited multi-directional movement of the golf club 24 relative to the swing training arm 18.

In operation, the golfer 26 preferrably utilizes the golf swing training apparatus 10 in conjunction with a golf pro, video, or written instructions. The golf pro positions the golfer on the stance mat 70 by having the golfer 26 place his feet on the appropriate areas on the stance mat 70. The pro evaluates the position of the golf club 24 relative to the golfer 26 and determines whether the vertical height of the swing training arm 18 needs to be adjusted based on the height of the golfer 26. In addition, the golf pro evaluates the position of the tee mat 82 to determine the proper positioning of the golf ball relative to the golfer 26. Once the golf pro has determined a proper stance for the golfer 26, the numerical values on the second, third, fourth, and fifth indicia 72, 80, 84, 92, respectively, are recorded. As a starting point, the first indicia 62 is set at the same value as the third indicia 80, which corresponds to the spacing of the golfer's feet. The golf pro may then adjust the alignment further to fit the golfer's particular swing. The numerical values on the indicia should be recorded and retained so that the golfer 26 may return to the apparatus 10 and obtain consistent results without the aid of the golf pro.

When the golfer 26 utilizes the golf swing training apparatus 10, the golfer 26 tries to develop a back swing that follows a particular swing plane 152, as seen in FIG. 1. If the golfer 26 correctly follows the swing plane 152, the telescopic shaft 104 of the swing training arm 18 will maintain its length. If the golfer 26 takes the golf club 24 in or out 154 of the swing plane 152, the telescopic shaft 104 of the swing training arm 18 will automatically expand or contract to compensate for the golfer 26 placing the golf club 24 in or out 154 of the swing plane 152. When this occurs, the golfer 26 feels the steel slug 114 give way from the magnetic pull of the magnets 112, and the golfer 26 realizes that his swing is in error. The golfer 26 may then reposition the swing training arm 18 by relocating the steel slug 114 back in the magnetic housing 110. The telescopic shaft 104 will easily retract to the predetermined biased length of the swing training arm 18 as the steel slug 114 is magnetically biased to the magnets 112 in the magnetic housing 110. The predetermined length of the swing training arm 18 may be identified by attaching a tape or indicia on the inner rod 108 to indicate where the tape should align with the end of the outer tube 106.

Figure 12:
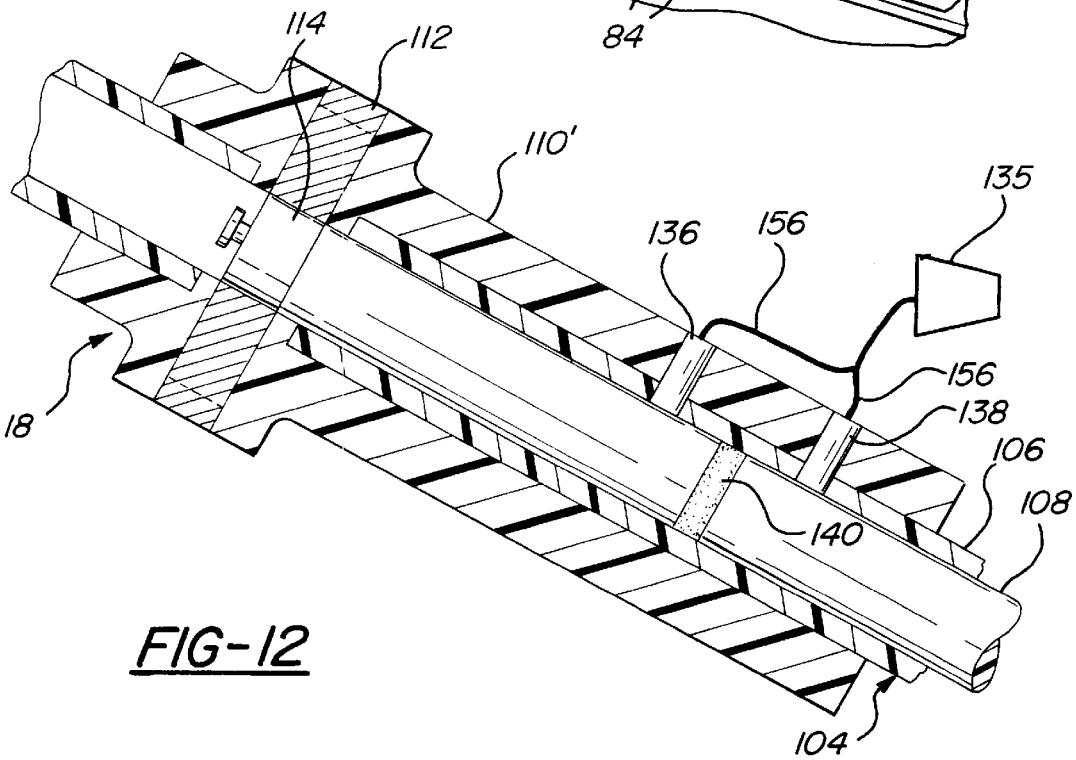
FIG. 12 is a sectional view of a second embodiment of the magnetic coupling.
Figure 12A:
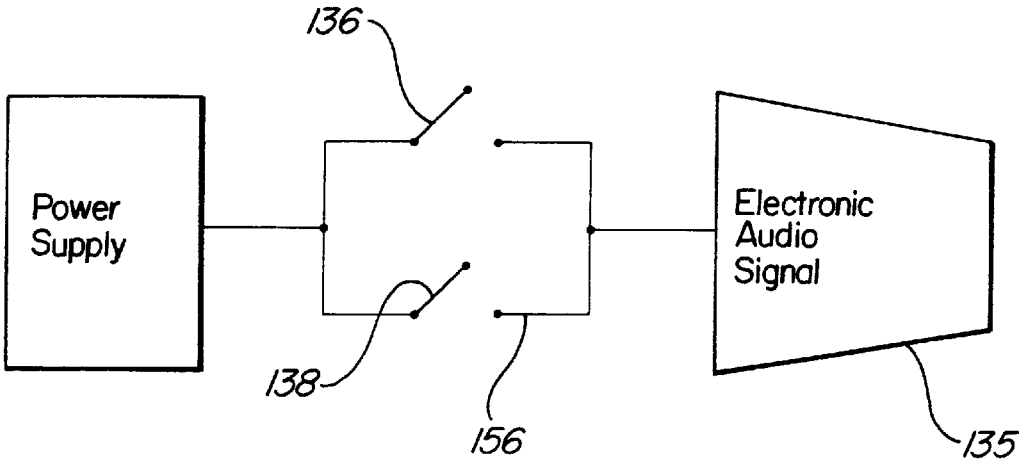

In an additional embodiment, an audible response mechanism 135 may be provided to indicate to the golfer 26 that an error has occurred in the back swing. As seen in FIG. 12, an audible response may be provided by extending the length of the magnetic housing 110 to house a pair of piezo or piezo-electric switches (or photoelectric cells) 136, 138. As shown in housing 110 a magnetic disk (or a gap if photoelectric cells are utilized) 140 is connected to the steel rod 108 and is axially spaced from the steel slug 114. The magnetic disk 140 is centered between the piezo or piezo-electric switches 136, 138 when the steel slug 114 is aligned with magnets 112 at the biased predetermined length of the swing training arm 18. When the golfer 26 errs and the telescopic shaft 104 expands or contracts, the magnetic disk 140 actuates one of the piezo or piezo-electric switches 136, 138. The switches 136, 138 actuate the audible response mechanism (not shown) by sending a signal through electric wires 156. An audio signal is generated to notify the golfer 26 that the golf club 24 has been brought in or out of the swing plane 152. The audible response mechanism (not shown) may be located on the vertical support member 14 or the swing training arm 18.

Figure 6:
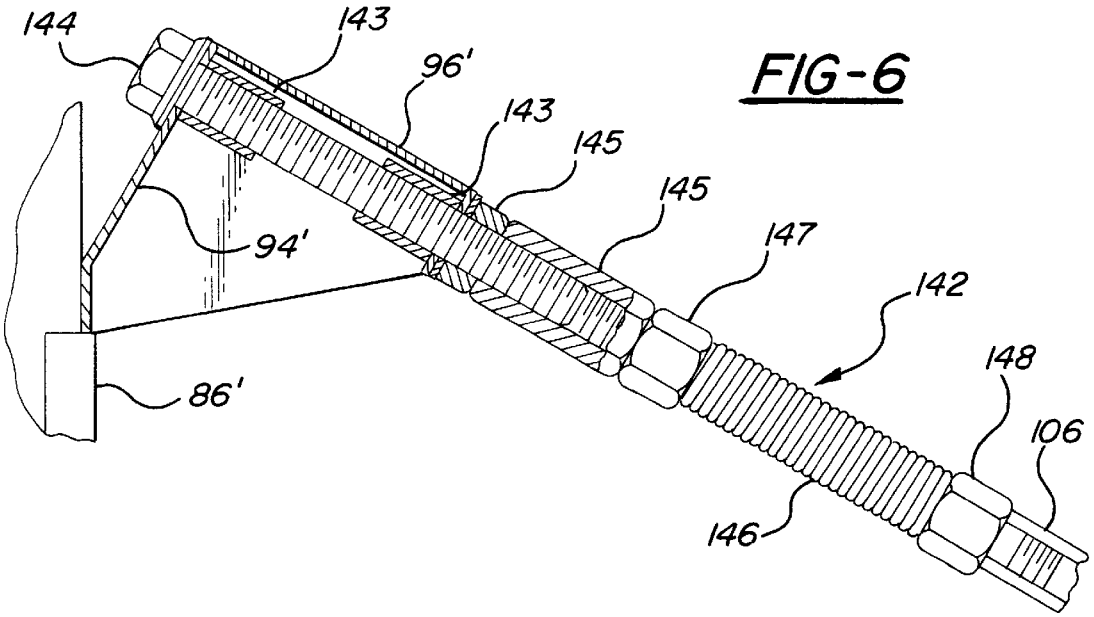
FIG. 6 is a second embodiment of the vertical adjustment bracket and articulating coupling for the swing arm.

In yet another embodiment, the universal joint 96 may take on other forms which provide similar articulate motion. FIG. 6 shows a spring assembly 142 which may be utilized to provide articulate motion to the swing training arm 18. The vertical adjustment bracket 86' is similar except that the end portion 94' has a C-shaped cross-section. A bolt 144 extends through the C shaped cross-section wherein a series of bushing 143 and nuts 145 are utilized to secure the bolt 144 to the vertical adjustment bracket 86'. A last coupling member 147 provides a rod wherein a coil-type spring 146 is press fit onto the rod. The opposite end of the spring 146 is threaded onto a coupling 148 which engages the end of the outer shaft 106 of the swing training arm 18.

Figure 10:
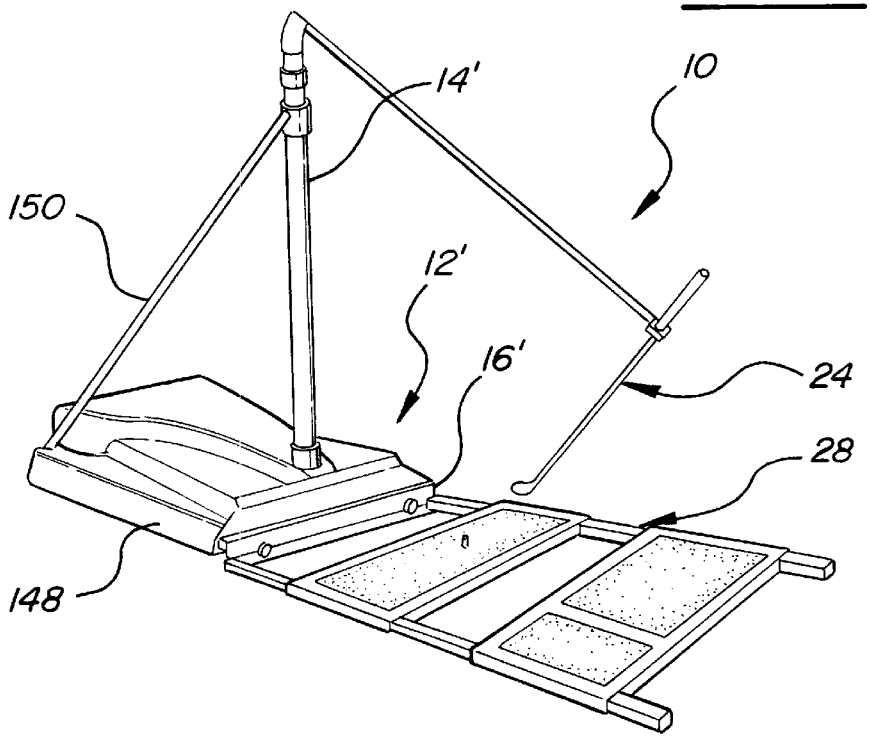
FIG. 10 is a perspective view of a second embodiment of the support structure wherein the support structure is self-standing.

In yet another embodiment of the invention, the support structure 12 may utilize a self-supporting support structure 12' as shown in FIG. 10. The self-supporting support structure 12' utilizes a weighted base 148 which may be filled with water, sand, gravel or the like. A vertical support structure 14' is connected to the weighted base 148 and may be supported by a plurality of additional struts 150. A horizontal support member 16' may then be connected to the front of the weighted base 148.

While the invention has been described in connection with what is presently considered to be the most practical and preferred embodiment, it is to be understood that the invention is not to be limited to these disclosed embodiments but, on the contrary, is intended to cover various modification and equivalent arrangements included within the spirit and scope of the appended claims, which scope is to be accorded the broadest interpretation so as to encompass all such modifications and equivalent structures as is permitted under the law.

What is claimed is:

1. An adjustable golf swing training apparatus, comprising:

a support structure for supporting said apparatus in a support plane; and a telescopic swing training arm connected to said support structure and connectable to a golf club shaft, said telescopic swing training arm biased toward a predetermined length, whereby said telescopic swing training arm is urged toward said predetermined length in response to axial movement of said telescopic swing training arm in either first or second directions away from said predetermined length; and wherein said predetermined length accommodates a preferred path of travel for a golf club through a portion of a golf swing.

2. The adjustable golf swing training apparatus of claim 1, further comprising:

said telescopic swing training arm comprising an inner rod and an outer tube;

at least one magnetic portion associated with said outer tube; and at least one magnetically attracted member associated with said inner rod, said magnetically attracted member aligned with said at least one magnetic portion to bias said telescopic swing training arm toward said predetermined length.

3. The adjustable golf swing training apparatus of claim 2, further comprising:

at least one switch responsive to axial misalignment of said magnetic portion relative to said magnetically attracted member; and at least one signal responsive to actuation of said switch.

4. The adjustable golf swing training apparatus of claim 3, further comprising:

a second magnetic portion associated with said inner rod of said telescopic swing training arm and axially spaced from said magnetically attracted portion;

said at least one switch associated with said outer tube of said telescopic swing training arm and axially spaced from said second magnetic portion, and said second magnetic portion actuating said at least one switch when said second magnetic portion becomes axially aligned with said at least one switch.

5. The adjustable golf swing training apparatus of claim 4, further comprising:

first and second switches associated with said outer tube of said telescopic swing training arm and axially spaced from each other such that said second magnetic portion is disposed between said first and second switches at said predetermined length of said telescopic swing training arm.

6. The adjustable golf swing training apparatus of claim 5, further comprising:

said at least one switch comprises a piezo-electric switch.

7. The adjustable golf swing training apparatus of claim 6, further comprising:

said at least one signal comprises an audio signal.

8. The adjustable golf swing training apparatus of claim 1, further comprising:

a releasable fastener for adjusting the position of said swing training arm with respect to said support structure, wherein said releasable fastener moves within said support plane.

9. The adjustable golf swing training apparatus of claim 7, further comprising:

indicia for indicating the position of said telescopic swing training arm relative to said support structure.

10. An adjustable golf swing training apparatus, comprising:

a support structure for supporting said apparatus in a support plane; and a telescopic swing training arm connected to said support structure and connectable to a golf club shaft, said telescopic swing training arm magnetically biased toward a predetermined length, whereby said telescopic swing training arm is urged toward said predetermined length in response to axial movement of said telescopic swing training arm in either first or second directions away from said predetermined length; and wherein said predetermined length accommodates a preferred path of travel for a golf club through a portion of a golf swing.

11. The adjustable golf swing training apparatus of claim 10, further comprising:

said telescopic swing training arm comprising an inner rod and an outer tube;

at least one magnetic portion associated with said outer tube; and at least one magnetically attracted member associated with said inner rod, said magnetically attracted member aligned with said at least one magnetic portion to bias said telescopic swing training arm toward said predetermined length.

12. The adjustable golf swing training apparatus of claim 11, further comprising:

at least one piezo-electric switch responsive to axial misalignment of said magnetic portion relative to said magnetically attracted member; and at least one signal responsive to actuation of said piezo-electric switch.

13. The adjustable golf swing training apparatus of claim 11, further comprising:

a second magnetic portion associated with said inner rod of said telescopic swing training arm and axially spaced from said magnetically attracted portion;

said at least one piezo-electric switch associated with said outer tube of said telescopic swing training arm and axially spaced from said second magnetic portion, and said second magnetic portion actuating said at least piezo-electric switch when said second magnetic portion becomes axially aligned with said at least one piezo-electric switch.

14. The adjustable golf swing training apparatus of claim 13, further comprising:

first and second piezo-electric switches associated with said outer tube of said telescopic swing training arm and axially spaced from each other such that said second magnetic portion is disposed between said first and second piezo-electric switches at said predetermined length of said telescopic swing training arm.

15. The adjustable golf swing training apparatus of claim 14, further comprising:

said at least one signal comprises an audio signal.

16. The adjustable golf swing training apparatus of claim 10, further comprising:

a releasable fastener for adjusting the position of said swing training arm with respect to said support structure, wherein said releasable fastener moves within said support plane.

17. The adjustable golf swing training apparatus of claim 16, further comprising:

indicia for indicating the position of said swing training arm relative to said support structure.

18. An adjustable golf swing training apparatus, comprising:

a support structure for supporting said apparatus in a support plane;

a telescopic swing training arm connected to said support structure and connectable to a golf club shaft, said telescopic swing training arm biased toward a predetermined length accommodating a preferred path of travel for a golf club through a portion of a golf swing;

at least one magnetic portion associated with said outer tube; and at least one magnetically attracted member associated with said inner rod, said magnetically attracted member being aligned with said at least one magnetic portion when said telescopic swing training arm is at said predetermined length so as to magnetically bias said telescopic swing training arm toward said predetermined length.

19. The adjustable golf swing training apparatus of claim 18, further comprising:

at least one piezo-electric switch responsive to axial misalignment of said magnetic portion relative to said magnetically attracted member; and at least one signal responsive to actuation of said at least one piezo-electric switch.

20. The adjustable golf swing training apparatus of claim 19, further comprising:

a second magnetic portion associated with said inner rod of said telescopic swing training arm and axially spaced from said magnetically attracted portion;

said at least one piezo-electric switch associated with said outer tube of said telescopic swing training arm and axially spaced from said second magnetic portion, and said second magnetic portion actuating said at least one piezo-electric switch when said second magnetic portion becomes axially aligned with said at least one piezo-electric switch.

21. The adjustable golf swing training apparatus of claim 20, further comprising:

first and second piezo-electric switches associated with said outer tube of said telescopic swing training arm and axially spaced from each other such that said second magnetic portion is disposed between said first and second piezo-electric switches at said predetermined length of said telescopic swing training arm.

22. The adjustable golf swing training apparatus of claim 21, further comprising:

said at least one signal comprises an audio signal.

23. The adjustable golf swing training apparatus of claim 18, further comprising:

a releasable fastener for adjusting the position of said swing training arm with respect to said support structure, wherein said releasable fastener moves within said support plane.

24. The adjustable golf swing training apparatus of claim 23, further comprising:

indicia for indicating the position of said swing training arm relative to said support structure.

* * * * *

UNITED STATES PATENT AND TRADEMARK OFFICE

CERTIFICATE OF CORRECTION

PATENT NO : 5,947,834

DATED : September 7, 1999

INVENTOR(S) : Hope, et al

It is certified that error appears in the above-identified patent and that said Letters Patent are hereby corrected as shown below:

Column 10, line 25, delete "piezo" and insert - - piezo-magnetic- -;

Column 10, line 30, delete "piezo", first occurrence, and insert - - piezo-magnetic - -;

Column 10, line 35, delete "piezo", first occurrence, and insert - - piezo-magnetic - -.

Signed and Sealed this

Twenty-fourth Day of October, 2000

*Attest:*

Q. TODD DICKINSON

*Attesting Officer*

*Director of Patents and Trademarks*